US006382621B1

(12) United States Patent
Inoue et al.

(10) Patent No.: US 6,382,621 B1
(45) Date of Patent: May 7, 2002

(54) PAPER FEEDER WITH MOVABLE SEPARATION SLOPE SURFACE AND IMAGE FORMING APPARATUS EQUIPPED THEREWITH

(75) Inventors: Ryukichi Inoue; Yoshihiro Matsuo, both of Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/432,171

(22) Filed: Nov. 2, 1999

(30) Foreign Application Priority Data

Nov. 4, 1998 (JP) ..... 10-313239

(51) Int. Cl.[7] ..... B65H 3/52; B65H 3/06; B65H 3/34

(52) U.S. Cl. ..... 271/120; 271/121; 271/167

(58) Field of Search ..... 271/120, 121, 271/18, 109, 34, 167, 21, 243; 400/758, 624, 629, 797.3; 358/498; 399/395

(56) References Cited

U.S. PATENT DOCUMENTS 5,253,854 A 10/1993 Tanoue et al. ..... 271/10
5,292,116 A 3/1994 Inoue et al. ..... 271/157
5,316,285 A * 5/1994 Olson et al. ..... 271/122 X
5,358,230 A 10/1994 Ikemori et al. ..... 271/114
5,443,251 A * 8/1995 Kan et al. ..... 271/16 X
5,651,540 A 7/1997 Watanabe et al. ..... 271/10.12
5,907,745 A 5/1999 Azuma et al. ..... 271/223
6,224,052 B1 * 5/2001 Nagano ..... 271/127 X

* cited by examiner

*Primary Examiner*—David H. Bollinger
*Assistant Examiner*—Kenneth W Bower
(74) *Attorney, Agent, or Firm*—Fitzpatrick, Cella, Harper & Scinto

(57) ABSTRACT

A paper feeder has a sheet stacking surface for stacking sheets, a paper feeding roller which is in contact with the uppermost surface of the sheets stacked on the sheet stacking surface to feed sheets, a movable separation slope surface against which the stacked sheets abut and which is rotatable between a first position and a second position that differ in the inclination angle made between it and the sheet stacking surface, and a separation control cam for rotating the movable separation slope surface between the first position and the second position. The angle made by the movable separation slope surface and the sheet stacking surface is set to be smaller than the angle when the sheets are separated so that the forward end portion of the pile of sheets stacked will not deform and when the sheets are fed by the paper feeding roller, the angle is set to be the angle when the movable separation slope surface separates the sheets by using the separation control cam.

22 Claims, 15 Drawing Sheets

PRIOR ART

PRIOR ART

PAPER FEEDER WITH MOVABLE SEPARATION SLOPE SURFACE AND IMAGE FORMING APPARATUS EQUIPPED THEREWITH

BACKGROUND OF THE INVENTION

1. Field of the Invention

The present invention relates to a paper feeder for feeding, one by one, sheets stacked together which is for use in an image forming apparatus or the like for forming images on sheets.

2. Description of the Related Art

A conventional paper feeder for use in image forming apparatuses adopts a slope surface separation system in which separation of sheets is effected by utilizing a slope surface. In the slope surface separation type paper feeder, a slope surface is provided at the forward end of the stacked sheets, and a paper feeding roller contacts the uppermost sheet to deliver it, the delivered sheet abutting the slope surface, whereby the sheets are separated from each other.

Usually, this slope surface separation type paper feeder is used when delivering sheets stacked horizontally. However, by inclining the sheet stacking surface, the installation area of the image forming apparatus can be reduced, and the apparatus size can be reduced, so that it is to be considered appropriate to apply the slope surface separation system to this inclined structure.

An example in which the slope surface separation system is applied to a paper feeder in which the sheet stacking surface is inclined will be described with reference to FIGS. 14 and 15. In the drawings, numeral 101 indicates a sheet stacking surface on which sheets S are to be placed, and numeral 102 indicates a paper feeding roller integrally holding a gear (not shown). Numeral 103 indicates an idler gear A in mesh with the gear of the paper feeding roller, numeral 104 indicates an idler gear B in mesh with the idler gear A 103, numeral 105 indicates a drive shaft, and numeral 106 indicates a drive gear fastened to the drive shaft 105 and in mesh with the idler gear B. Numeral 107 indicates a paper feeding roller arm rotatably holding the paper feeding roller 102 and the idler gears 103 and 104 and rotatably held by the drive shaft 105.

Numeral 108 indicates a separation slope surface which supports the sheets and which is at an angle θ with respect to the sheet stacking surface 101, numeral 109 indicates a lower guide which is integral with the separation slope surface 108 and which guides the lower side of the sheets fed, and numeral 110 indicates an upper guide for guiding the upper side of the sheets. Numeral 111 indicates a conveying roller which rotates to thereby apply to the sheets fed a conveying force for guiding the sheets in a predetermined direction, and numeral 112 indicates a rotatable conveying roller arranged opposite to the conveying roller 111. Numeral 113 indicates a roller holder which rotatably holds the conveying roller 112 and which is held by the upper guide, etc., and numeral 114 indicates a conveying spring which biases the roller holder 113 and which presses the conveying roller 112 against the conveying roller 111.

Numeral 115 indicates a conveying guide for guiding the lower side of the sheets between the paper feeding and the fixing unit. Numeral 116 indicates a toner cartridge, numeral 117 indicates a development drum in the toner cartridge, numeral 118 indicates a transfer roller which is pressed against the development drum 117 and rotates and which transfers the toner image on the development drum 117 to the sheet, numeral 119 indicates a fuser for fixing the toner image to the sheet, numeral 120 indicates a heating device for heating the toner and sheet in the fuser 119, and numeral 121 indicates a fixing roller which rotates as it presses the sheet against the heating device 120 to convey the sheet.

Numeral 128 indicates a scanner for writing the latent image on the development drum 117 by a laser beam or the like, numeral 129 indicates an optical stand securing the scanner in position, and numeral 130 indicates an electrical portion formed by a power source for the entire image forming apparatus, a control circuit, etc.

Numeral 122 indicates a paper discharge roller pair A for conveying the sheet after fixing, numerals 123 and 124 indicate an upper paper discharge guide and a lower paper discharge guide for guiding the sheet conveyed by the discharge roller pair A, numeral 125 indicates a paper discharge roller B for discharging the sheet guided by the paper discharge guides 123 and 124 to the exterior of the image forming apparatus, numeral 126 indicates a rotatable paper discharge roller pressurized toward the paper discharge roller B 125, and numeral 127 indicates a paper discharge tray on which the sheets discharged are stacked.

The paper feeding operation of the paper feeder constructed as described above will now be described.

The drive shaft 105 is driven by a controllable drive mechanism (not shown). As a result, the starting and stopping of the paper feeding operation is controlled. When starting paper feeding, the drive shaft 105 is driven by a drive mechanism (not shown) and rotates. This rotation is transmitted through the idler gear B 104 and the idler gear A 103 to the paper feeding roller 102, and the paper feeding roller 102 starts to rotate. The paper feeding roller arm 107 holding the paper feeding roller 102 so as to be rotatable around the drive shaft 102 is biased so as to rotate counterclockwise as seen in the drawing by a biasing means (not shown) or by its own weight, and, by this biasing force, the paper feeding roller 102 is slightly in press contact with the upper surface of the uppermost sheet $S_1$ of the pile of sheets S stacked on the sheet stacking surface.

Thus, by starting rotation of the paper feeding roller 102, a feeding force F due to frictional force is applied to the sheet $S_1$. The sheet $S_1$ receives a reactive force $F_2$ from the separation slope surface 108; due to this reactive force $F_2$, the sheet $S_1$ is bent, whereby the sheet $S_1$ moves on the separation slope surface 108, with its forward end portion abutting and being bent.

The proceeding direction of the sheet $S_1$ is determined by the upper guide 110 and the lower guide 109, and it enters a nip defined by the conveying roller 112 biased toward the conveying roller 111, and, by the rotation of the conveying roller 111, it is further fed downward with respect to the sheet conveying direction.

The sheet $S_1$ is then guided by the conveying guide 115 and fed to the nip between the development drum 117 and the transfer roller 118. The latent image written to the development drum 117 by the scanner 128 is developed in the toner cartridge 117 and transferred to the sheet by the transfer roller 118. The toner transferred to the sheet is fixed in the fuser to the sheet, and the sheet to which the image has been fixed is stacked on the paper discharge tray 127 outside the image forming apparatus by the paper discharge roller pair A 122 and the paper discharge roller B 125.

The above-described conventional apparatus has the following problems.

If, when inserting a pile of sheets S in the paper feeder for the purpose of supplying sheets, etc., the pile of sheet is put in by firmly abutting it against the separation slope surface 108 along the sheet stacking surface 101 or by causing it to drop in by its own weight, the forward end portion of the pile of sheets S abuts the separation slope surface 108 and is bent (buckles) as shown in FIG. 15. When the forward end portion of the pile of sheets S is thus bent, a plurality of sheets begin to deform simultaneously at the time of paper feeding, resulting in duplicate or multifold feeding.

Further, the sheets other than the uppermost sheet are influenced by frictional force when the uppermost sheet is fed, so that, by repeating the paper feeding operation, part of the pile of sheets S is bent as shown in FIG. 15, resulting in multifold feeding. This often happens near the boundary between the pile of sheets S, which has been reduced in volume as a result of paper feeding, and another pile of sheet newly supplied and placed thereon.

SUMMARY OF THE INVENTION

The present invention has been made in view of the above problems. Accordingly, it is an object of the present invention to provide a paper feeder of the type which has a sheet stacking surface obliquely holding a pile of sheets and which adopts the slope surface separation system, wherein no such inconvenience as multifold feeding is involved even when the pile of sheets is forcibly put in the paper feeder or caused to drop in it by its own weight at the time, for example, of supplying sheets.

In accordance with these objects, there is provided a paper feeder comprising a sheet stacking surface on which sheets are stacked, paper feeding means for feeding the sheets stacked on the sheet stacking surface, the paper feeding means in contact with an uppermost sheet of the sheets stacked on the sheet stacking surface, and a movable separation slope surface arranged such that a leading end of the sheets stacked on the sheet stacking surface abuts the movable separation slope-surface, the movable separation slope surface being rotatable between a first position and a second position that differ in inclination angle made by the movable separation slope surface and the sheet stacking surface. Driving means are also provided for rotating the movable slope surface between the first position and the second position.

In accordance with another object of the present invention there is provided an image forming apparatus containing a paper feeder as described above and image forming means for forming images on sheets fed from that paper feeder.

Further, in a structure in which a rotatably supported roller is provided at the end of the movable separation slope surface farther from the sheet stacking surface, it is possible to mitigate the resistance offered to the sheets conveyed with its forward end sliding when the movable separation slope surface is in the second position.

Further, when the movable separation slope surface is not moved to the second position in a first paper feeding operation by the paper feeding means, and the movable separation slope surface is moved from the first position to the second position in a second paper feeding operation, it is possible to effect setting such that the possibility of multifold feeding is further reduced when a sort of sheets which require small paper feeding force for passing the movable separation slope surface are caused to flow in a large amount.

Further, when control is effected such that the timing for starting the paper feeding means is delayed as compared with the timing for starting the movable separation slope surface, the uppermost sheet is temporarily separated from the pile of sheets below it with a smaller force before the starting of the paper feeding means, thereby making it possible to restrain the occurrence of multifold feeding.

Further objects, features and advantages of the present invention will become apparent from the following description of the preferred embodiments with reference to the attached drawings.

DESCRIPTION OF THE PREFERRED EMBODIMENT

First Embodiment

Figure 1:
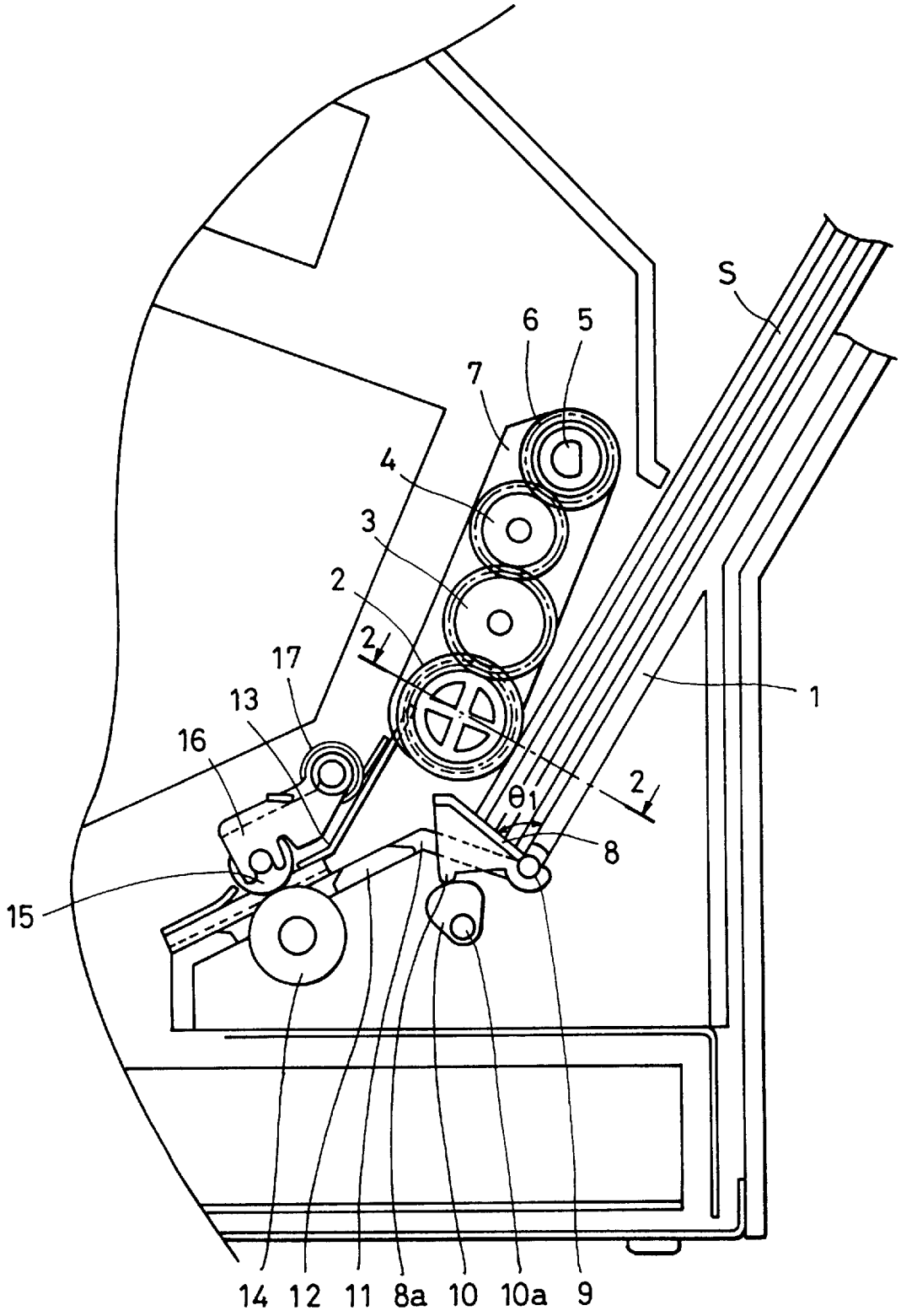
FIG. 1 is a main sectional view showing a paper feeder according to an embodiment of the present invention in a standby state.
Figure 2:
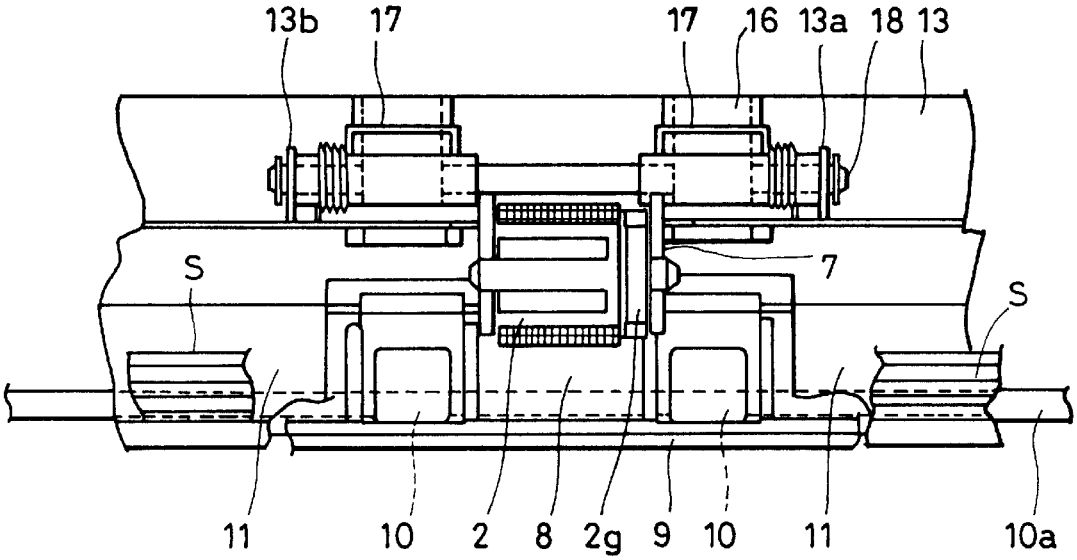
FIG. 2 is a schematic sectional view taken along the line 2—2 of FIG. 1.

The first embodiment of the present invention will be described with reference to FIGS. 1 and 2. FIG. 1 is a sectional view most clearly showing the features of the present invention; and FIG. 2 is a sectional view taken along the line X—X of FIG. 1.

In FIG. 1, numeral 1 indicates a sheet stacking surface, which is inclined approximately 60 degrees with respect to the horizontal plane in this embodiment. The present invention is effectively applicable when this angle is at least 10 degrees. Symbol S indicates a pile of sheets stacked, numeral 2 indicates a paper feeding roller integrally holding a gear (not shown), numeral 3 indicates an idler gear A in mesh with the gear of the paper feeding roller 2, numeral 4 indicates an idler gear B in mesh with the idler gear A 3, numeral 5 indicates a drive shaft, and numeral 6 indicates a drive gear fastened to the drive shaft 5 and in mesh with the idler gear B4. Numeral 7 indicates a paper feeding roller arm rotatably holding the paper feeding roller 2 and the idler gears 3 and 4 and rotatably held by the drive shaft 5.

Numeral 8 indicates a movable separation slope surface which supports sheets and which is at an angle $\theta_1$ with respect to the sheet stacking surface 1, numeral 9 indicates a rotation shaft for the movable separation slope surface 8, numeral 10 indicates a separation control cam capable of rotating with a predetermined timing by a rotation control mechanism (not shown), and numeral 8*a* indicates a protrusion of the movable separation slope surface 8 which is in contact with the separation control cam 10.

Numeral 11 indicates a forward end guide surface which is in the rotation range of the movable separation slope surface 8 and which is at a position somewhat spaced apart from the range in which the forward end of the sheet S can be positioned, numeral 12 indicates a lower guide for guiding the lower side of the sheet conveyed, numeral 13 is an upper guide for guiding the upper side of the sheet, numeral 14 indicates a conveying roller for applying to the sheet a conveying force for moving the sheet fed in a predetermined direction by its rotation, numeral 15 indicates a rotatable conveying roller arranged opposite to the conveying roller 14, numeral 16 indicates a roller holder rotatably holding the conveying roller 15 and held by the upper guide 13, and numeral 17 indicates a conveying spring biasing the roller holder 16 and pressing the conveying roller 15 against the conveying roller 13.

In FIG. 2, numeral 2*g* indicates a gear integrally formed with the paper feeding roller 2, the gear 2*g* being in mesh with the idler gear A 3.

Numeral 18 indicates a rotation shaft of a roller holder 17, and numeral 13*a* and 13*b* indicate holding portions for holding the rotation shaft 18, which holding portions are formed integrally with the upper guide 13. Numeral 10*a* indicates a separation cam shaft which is secured to the separation control cam 10 and which is connected with a one rotation control mechanism (not shown).

Figure 3:
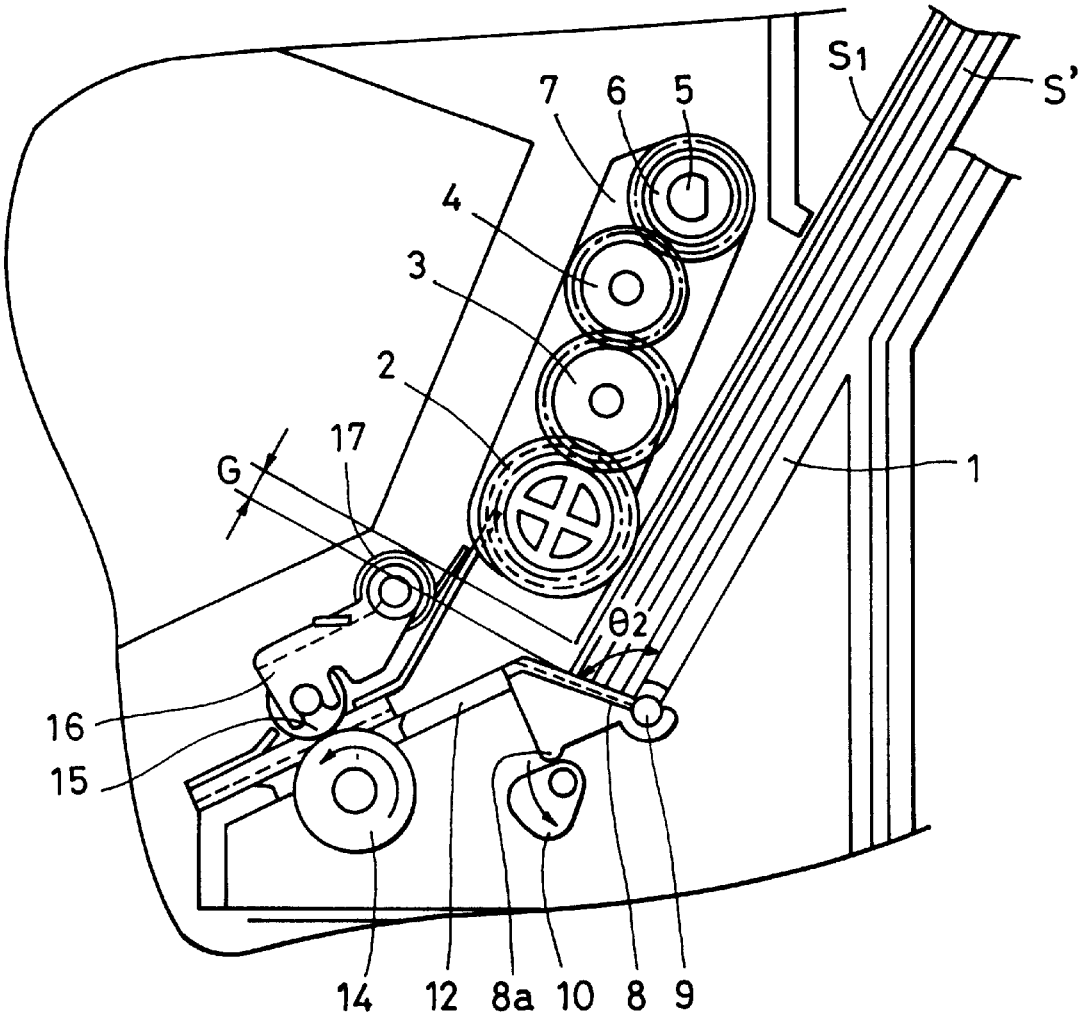
FIG. 3 is a main sectional view showing the paper feeder of the first embodiment in an initial stage of paper feeding operation.
Figure 4:
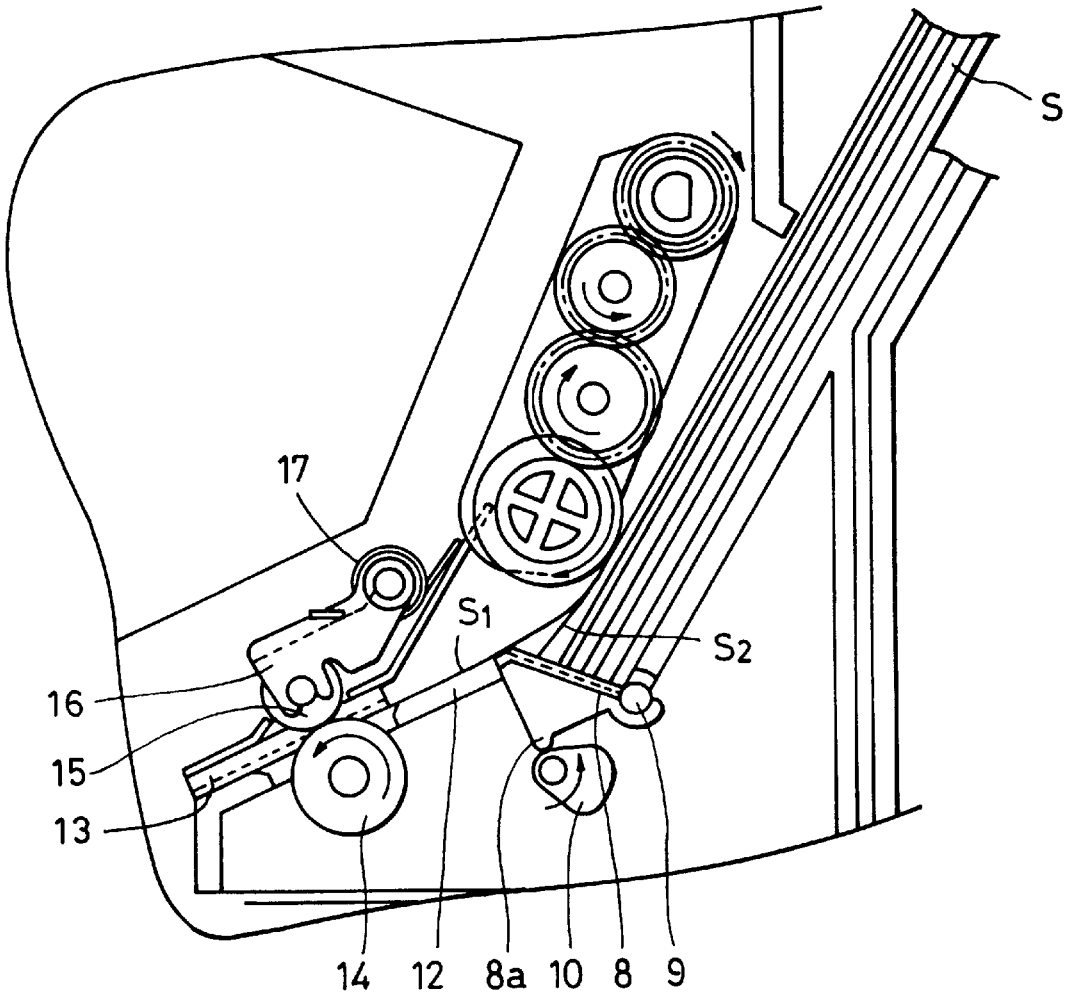
FIG. 4 is a main sectional view showing the paper feeder of the first embodiment in a middle stage of paper feeding operation.
Figure 5:
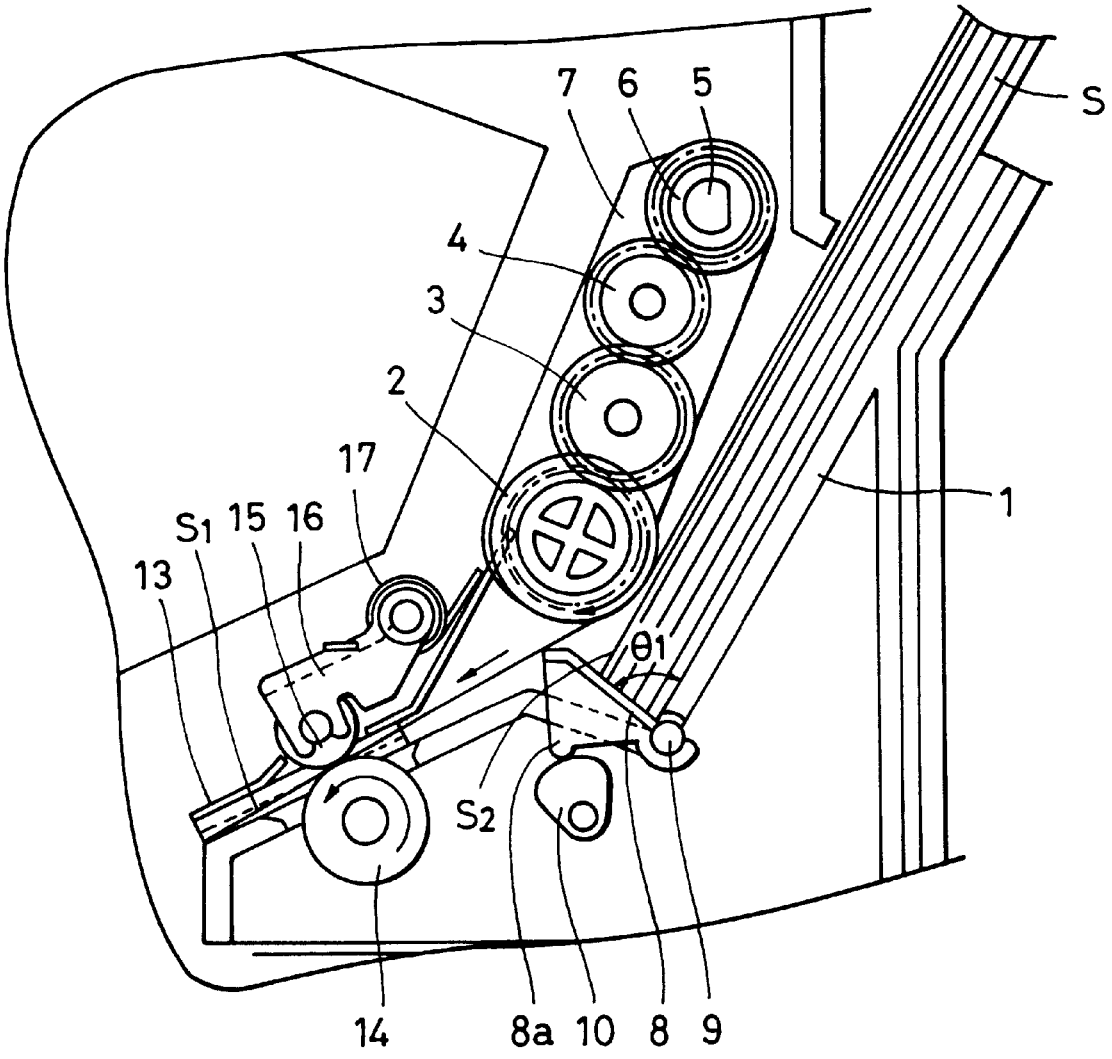
FIG. 5 is a main sectional view showing the paper feeder of the first embodiment in a final stage of paper feeding operation.

Next, FIGS. 3 through 5 are diagrams illustrating how the sheets on the movable separation slope surface 8 are separated and conveyed.

FIG. 3 shows the initial state in which the paper feeding operation of the paper feeder is started. In FIG. 3, the separation control cam 10 is rotated by a predetermined angle from the position shown in FIG. 1, whereby the movable separation slope surface 8 is at an angle θ2 with respect to the sheet stacking surface 1. Numeral S1 indicates the uppermost sheet of the pile of sheets S, and symbol G indicates a distance by which the forward end of S1 is deviated from the other sheets as a result of the paper feeding roller 2 being at rest. This deviation G is generated due to the fact that the uppermost sheet S1 is pressed by the paper feeding roller 2 that is at rest when the movable separation slope surface 8 rotates, whereas the other sheets move downward with the rotation of the movable separation slope surface 8.

FIG. 4 shows the condition in which the paper feeding operation has progressed from the state of FIG. 3. In the drawing, numerals 1 through 17 indicate the same components as those shown in FIG. 1. Numeral S2 indicates a sheet arranged directly under the uppermost sheet S1. At this point in time, the paper feeding roller 2 and the drive system for transmitting driving force thereto rotate in the direction of the arrow.

FIG. 5 shows the final stage of the paper feeding operation, in which the angle made by the movable separation slope surface 8 with the sheet stacking surface 1 is θ1, which is the same as that in FIG. 1, thus restoring the original condition.

The paper feeding operation of the paper feeder constructed as described above is performed as follows.

The pile of sheets S is supplied onto the sheet stacking surface 1 by the user. When the paper feeder is at rest, the movable separation slope surface 8 is held by the separation control cam 10 at the first position in which it is at angle θ1 with respect to the sheet stacking surface 1. This angle θ1 is an acute angle.

When the paper feeding operation is started, the separation cam 10 connected with the one rotation control mechanism (not shown) first rotates, and, with this rotation, the separation control cam 10 starts to rotate. This state is shown in FIG. 3. The paper feeding roller 2 is at rest since no driving force is applied thereto. Even when the movable separation slope surface 8 moves with the rotation of the separation control cam 10, and most of the sheets of the pile of sheets S follow to move downward, the uppermost sheet S1 which is in contact with the paper feeding roller 2 that is at rest does not follow. Thus, the forward end of the uppermost sheet S1 is deviated by a distance G from the forward end of other sheets, that is, from the movable separation slope surface 8, as shown in FIG. 3. At the bottom dead center of the separation control cam 10, the movable separation slope surface 8 is at the second position, at which it is at an angle θ2 with respect to the sheet stacking surface 1, the angle θ2 being an obtuse angle.

In the state shown in FIG. 4, when the separation control cam 10 reaches the bottom dead center, the drive shaft 5 is driven by a drive control mechanism (not shown) to start to rotate, and the driving force is transmitted to the drive gear 6, the idler gear B 4, and the idler gear A 3, driving force being transmitted to the gear 2*g* connected with the paper feeding roller 2 to rotate the paper feeding roller 2.

As shown in FIG. 3, the forward end of the uppermost sheet S1 is spaced apart from the movable separation slope surface 8, so that the sheet S1 starts to move even with a weak feeding force, and the coefficient of friction between the sheet S2, which is under the sheet S1, and the sheet S1 is more of a coefficient of dynamic friction as compared with that in the initial stage. That is, at the point in time when the sheet S1 abuts the movable separation slope surface 8 and is bent to separate from the sheet S2, the sheet S1 has moved relative to the sheet S2. As a result, the sheet S1, which moves forward due to the frictional force between it and the paper feeding roller 2 is bent by the reactive force it receives from the movable separation slope surface 8, and moves forward over the movable separation slope surface 8, whereas the sheet S2, which receives a weak dynamic frictional force from the sheet S1, receives the frictional force between it and the sheet under it as a braking force, and is stopped by the movable separation slope surface 8, so that it cannot move forward.

FIG. 5 shows the final stage of the paper feeding operation. At this point in time, the separation slope surface 8 is at an angle θ1 with respect to the sheet stacking surface 1 as in FIG. 1, and a one rotation control mechanism (not shown) holds the separation control cam 10 in this state. Since θ1 is an acute angle, the sheet S2, which has been to some degree on the movable separation slope surface 8 in FIG. 4, also receives a weak frictional force from the sheet S1 moving forward, and is brought back to the position in which it is in close contact with the other sheets of the pile S. While in FIG. 5 the paper feeding roller 2 is rotating, no problem is involved if it is at rest.

The uppermost sheet S1 enters a nip formed by the rotating conveying roller 14 and the conveying roller 15 biased by the conveying spring 17, and receives a conveying force from the rotating conveying roller 14, and is transmitted to an image forming means (not shown) having a conventional construction.

In the construction of this embodiment, it is possible to realize a paper feeder in which the separation control cam 10 is held without being rotated at the first paper feeding operation, and only the paper feeding roller 2 is rotated to feed sheets which are thin and subject to multifold feeding, and, only when sheets cannot be fed by the first paper feeding operation, the above paper feeding operation is conducted as a second paper feeding operation.

The above construction provides the following advantages.

Figure 15:
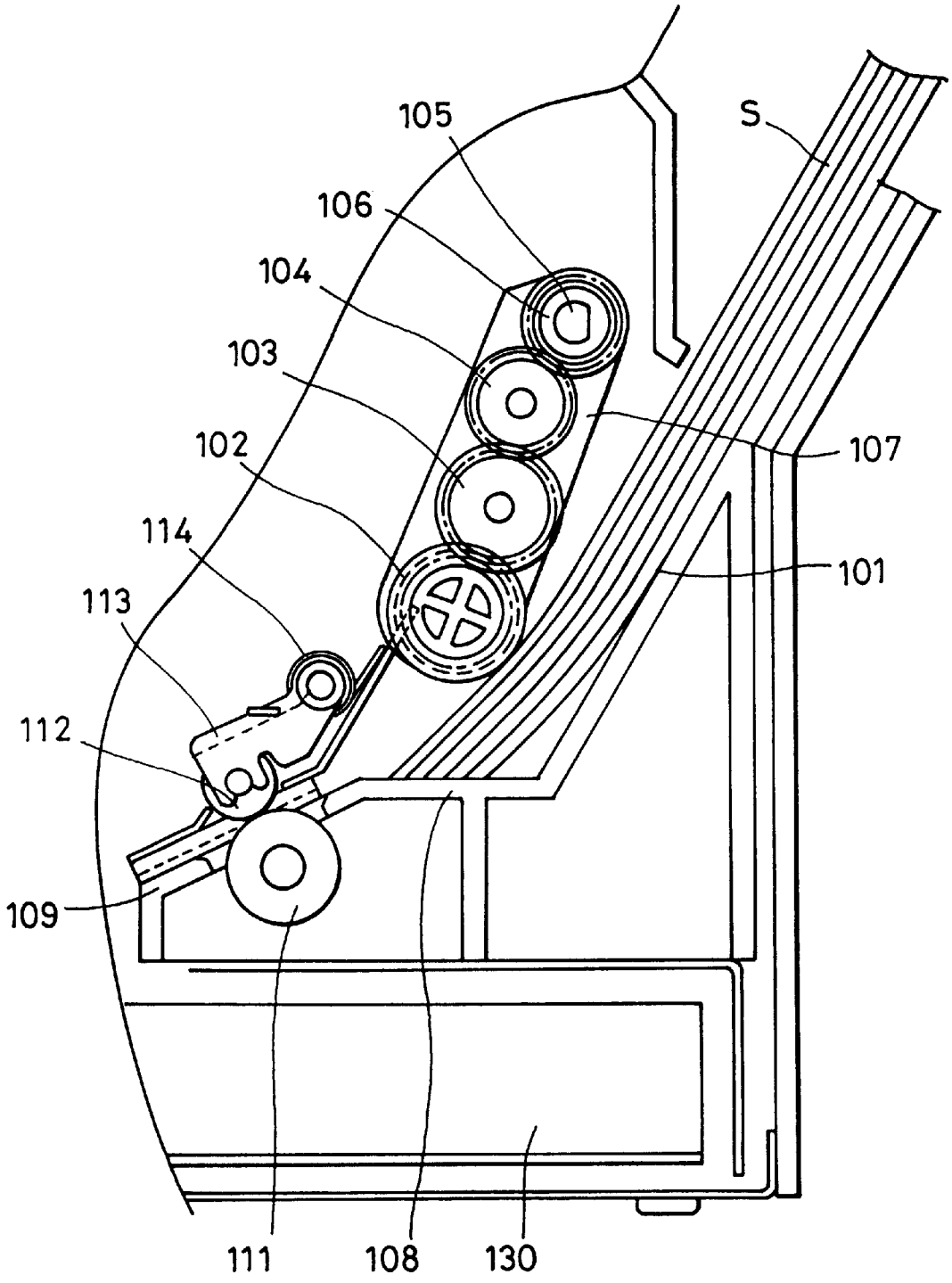
FIG. 15 is a main sectional view of the conventional paper feeder showing a pile of sheets in a position which often leads to multifold feeding.

(1) In the standby state, the angle made by the movable separation slope surface 8 and the sheet stacking surface 1 is an acute angle, so that, even if the pile of sheets is forcibly put in the paper feeder or caused to drop in it by its own weight, the pile of sheets is held in contact with the sheet stacking surface 1 in a position parallel thereto, and the condition as shown in FIG. 15 is not brought about. Thus, the angle the pile of sheets makes with the movable separation slope surface 8 can be stably set to a predetermined angle, so that multifold feeding does not occur.

(2) For each paper feeding operation, the angle of the movable separation slope surface 8 is restored to an acute angle, so that even if there is a border surface with a particularly inter-sheet frictional coefficient, such as an additional sheet surface, the plurality of sheets above this border surface are not brought to the condition shown in FIG. 15, whereby it is possible to prevent continuous multifold feeding.

(3) Since the timing for starting the paper feeding roller 2 is delayed as compared to the timing for starting the movable separation slope surface 8, a deviation of the forward end of the sheet as shown in FIG. 3 is generated. As a result, the transition of the coefficient of friction between the uppermost sheet and the sheet under it to a coefficient of dynamic friction can be effected in an early stage, thereby preventing multifold feeding of thin sheets.

(4) In the first paper feeding operation, the separation control cam 10 is held without being rotated, and only the paper feeding roller 2 is rotated to feed thin sheets which are subject to multifold feeding; only when the sheet does not move by the first paper feeding operation, the above paper feeding operation is conducted as a second paper feeding operation, whereby it is possible for the paper feeder to be applied to a variety of sheets.

Second Embodiment

Figure 6:
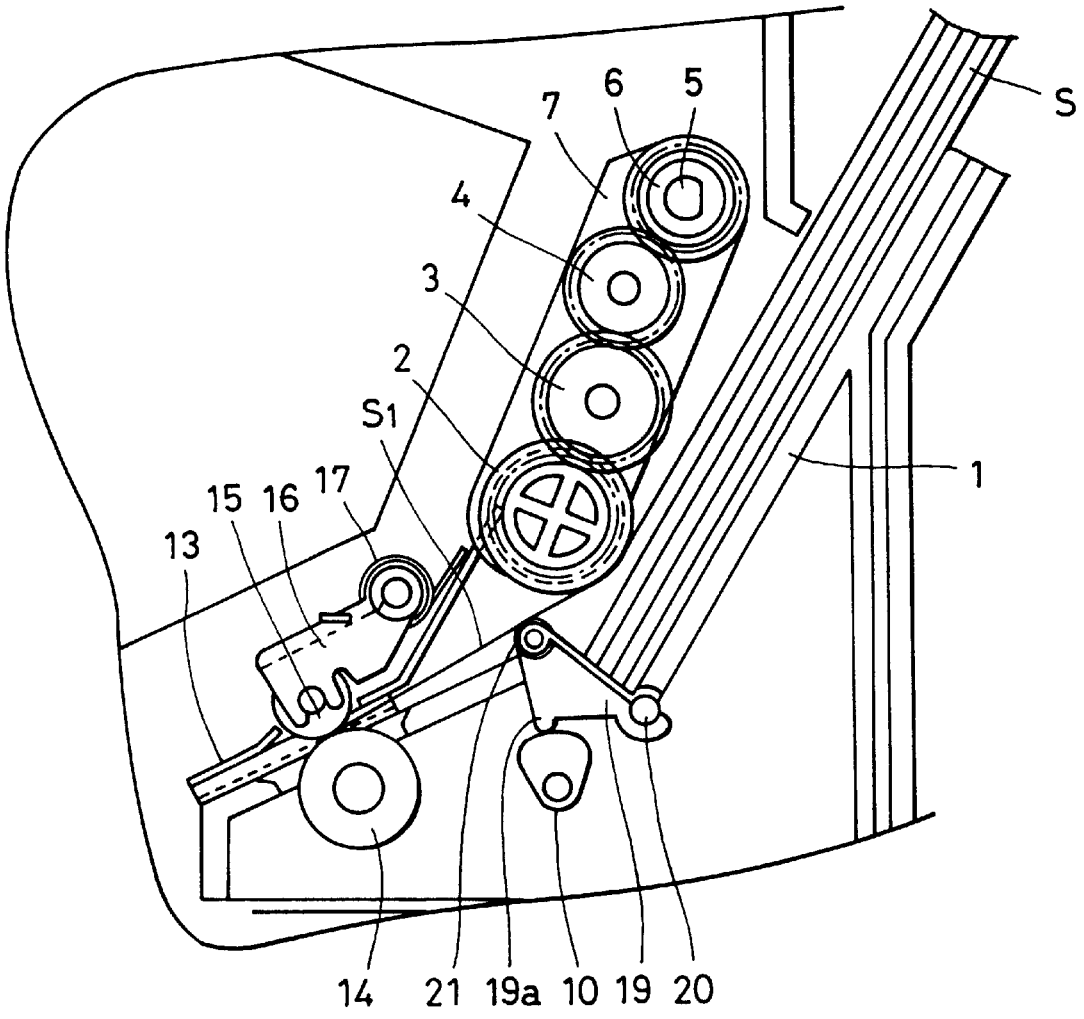
FIG. 6 is a main sectional view showing the paper feeder of the second embodiment in a final stage of paper feeding operation.

FIG. 6 shows a second embodiment of the present invention. In the drawing, the components which are the same as those of the first embodiment and the sheets are indicated by the same reference numerals.

In the drawing, numeral 19 indicates a movable separation slope surface, and numeral 19*a* indicates a protrusion of the movable separation slope surface 19, which is in contact with the separation control cam 10. Numeral 20 indicates a rotation shaft of the movable separation slope surface 19, and numeral 21 indicates a sliding roller rotatably held at the paper passing side end of the movable separation slope surface 19. The paper feeding operation of this paper feeder constructed as described above is substantially the same as that of the first embodiment.

The advantage of this embodiment is as follows. By providing the rotatable sliding roller 21 at the paper passing side end of the movable separation slope surface 19, damage to the sheet Si, which is conveyed sliding on the movable separation slope surface 19 after the paper feeding operation, can be minimized. Further, wear of the forward end of the movable separation slope surface 19 can be eliminated.

Third Embodiment

Figure 7:
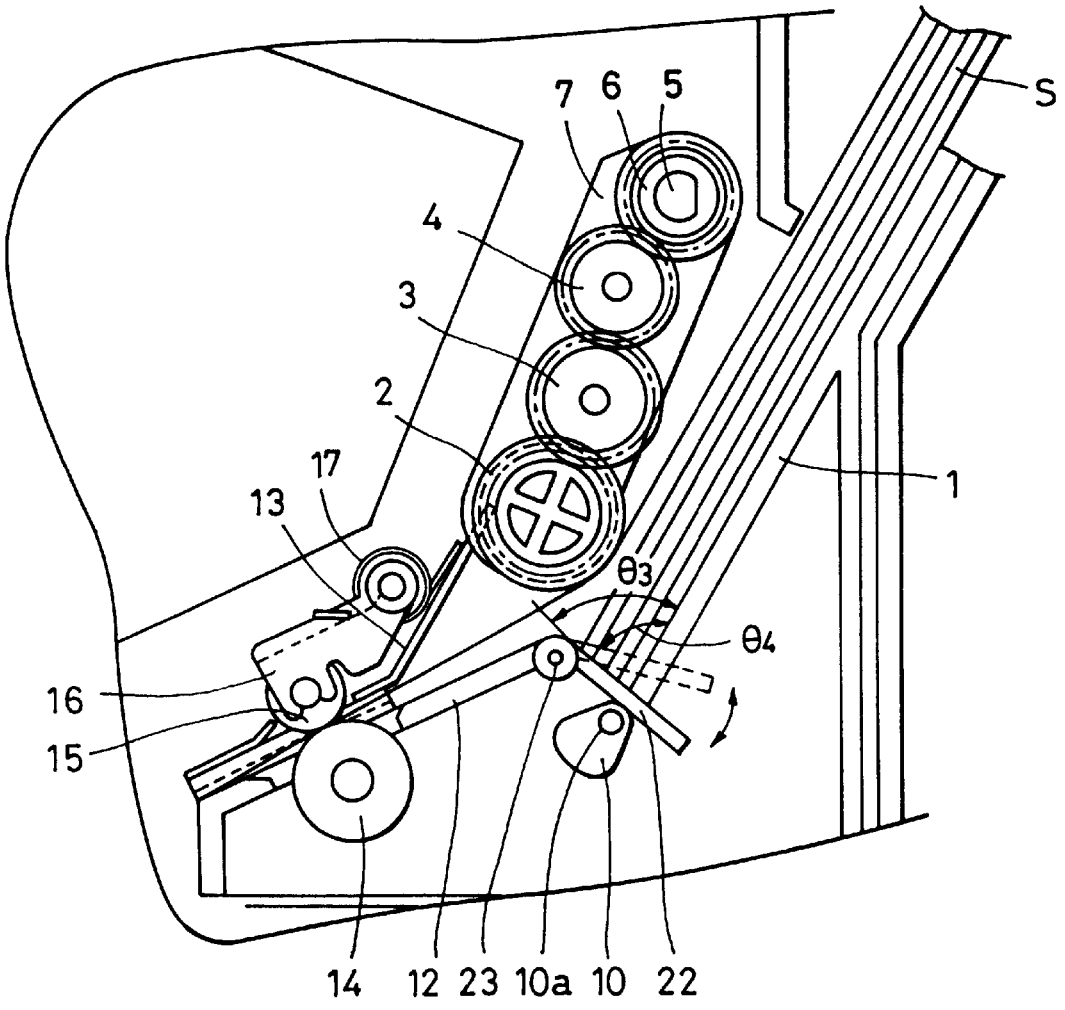
FIG. 7 is a main sectional view showing the paper feeder of the third embodiment in a final stage of paper feeding operation.

FIG. 7 shows a third embodiment of the present invention. In the drawing, the components which are the same as those of the first embodiment are indicated by the same reference numerals. In the drawing, numeral 22 indicates a movable separation slope surface rotating around a rotation shaft 23, which is arranged such that the sheet stacking surface 1 side of the movable separation slope surface 22 swings.

The paper feeding operation of the paper feeder, constructed as described above, is performed as follows. The pile of sheets S is placed by the user on the sheet stacking surface 1. When the paper feeder is at rest, the movable separation slope-surface 22 is held by the separation control cam 10 such that it makes an angle θ3 with respect to the sheet stacking surface 1. When the paper feeding operation is started, a separation cam shaft 10*a* connected to a one rotation control mechanism (not shown) first rotates, and, with this rotation, the separation control cam 10 also starts to rotate. Even when the movable separation slope surface 22 moves with the rotation of the separation control cam 10, and most of the sheets of the pile S follow to move downward, the uppermost sheet S1 which is in contact with the paper feeding roller 2 that is at rest and to which brake is applied does not follow.

Thus, in the case of sheets of low rigidity such as thin paper, the uppermost sheet S1 starts to buckle, and the forward end thereof runs onto the movable separation slope surface 22. At the bottom dead center of the separation control cam 10, the movable separation slope surface 22 and the sheet stacking surface 1 make an angle θ4, which is an obtuse angle.

Next, driven a drive control mechanism (not shown), the drive shaft 5 starts to rotate, and driving force is transmitted to the drive gear 6, the idler gear B4, and the idler gear A3; driving force is transmitted to the gear 2*g* connected with the paper feeding roller 2, and the paper feeding roller 2 rotates. Since the forward end of the uppermost sheet S1 has run onto the movable separation slope surface 22, movement is started with a weak feeding force, and the coefficient of friction of the sheet S2, which is under the sheet S1, and-the sheet S1 becomes more of a coefficient of dynamic friction as compared with that in the early stage. Thus, the sheet S1, which advances due to the frictional force between it and the sheet S2, moves over the movable separation slope surface 22, whereas the sheet S2, which receives weak dynamic frictional force from the sheet S1, is stopped by the movable separation slope surface 22, and cannot advance, the frictional force between it and the sheet under it working as a braking force.

In the final stage of paper feeding operation, the separation control cam 10 makes the same angle θ3 as in the standby state with the sheet stacking surface 1, and, in this condition, a one rotation control mechanism (not shown) holds the separation control cam 10. Since the angle θ3 is an acute angle, the sheet S2, which has run onto the movable separation slope surface 22 to some degree in FIG. 4, also receives weak frictional force from the advancing sheet S1, and is restored to the position in which it is in close contact with the other sheets of the pile S. When the pile of sheets S consists of sheets having high rigidity as in the case of cardboard, the sheets do not buckle, and the uppermost sheet S1 moves in synchronism with the pile of sheets S.

This embodiment Is advantageous in that there is little variation in the torque for rotating the separation control cam 10 between the state in which the paper feeder is full and the state in which only a small quantity of sheets are loaded.

Fourth Embodiment

Figure 8:
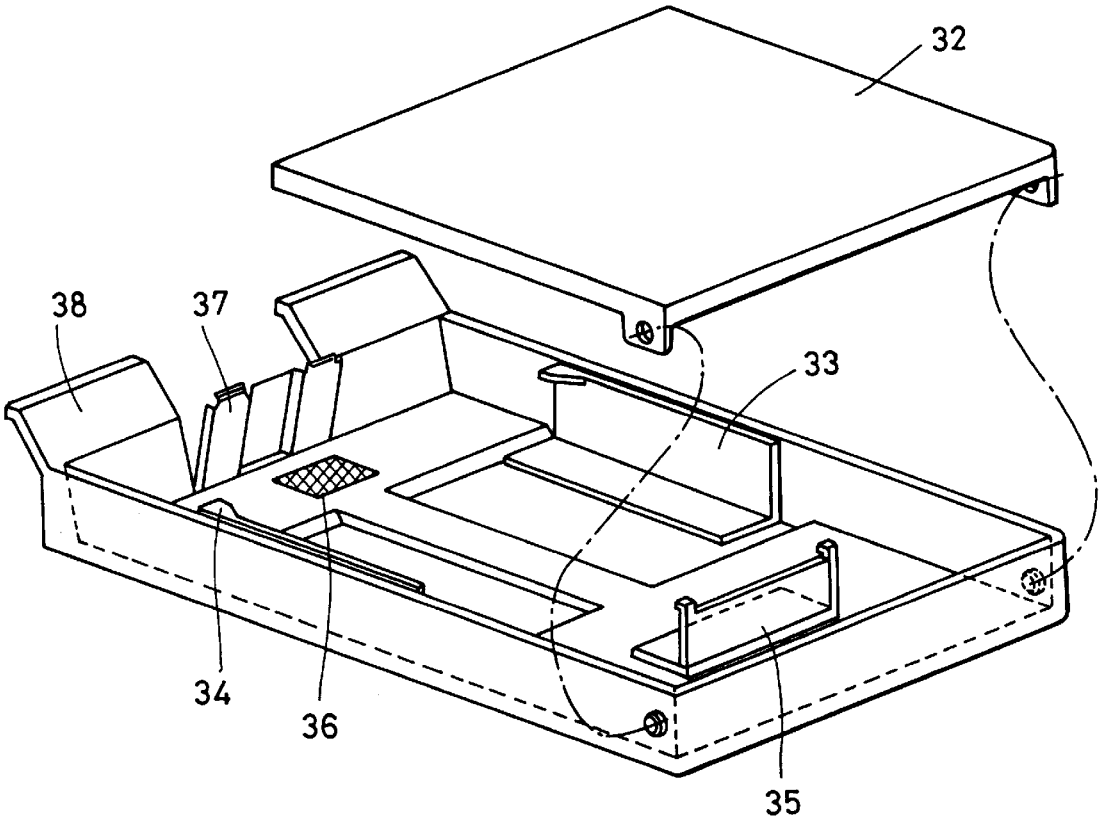
FIG. 8 is a perspective view of a paper feeding tray according to a fourth embodiment of the present invention.
Figure 9:
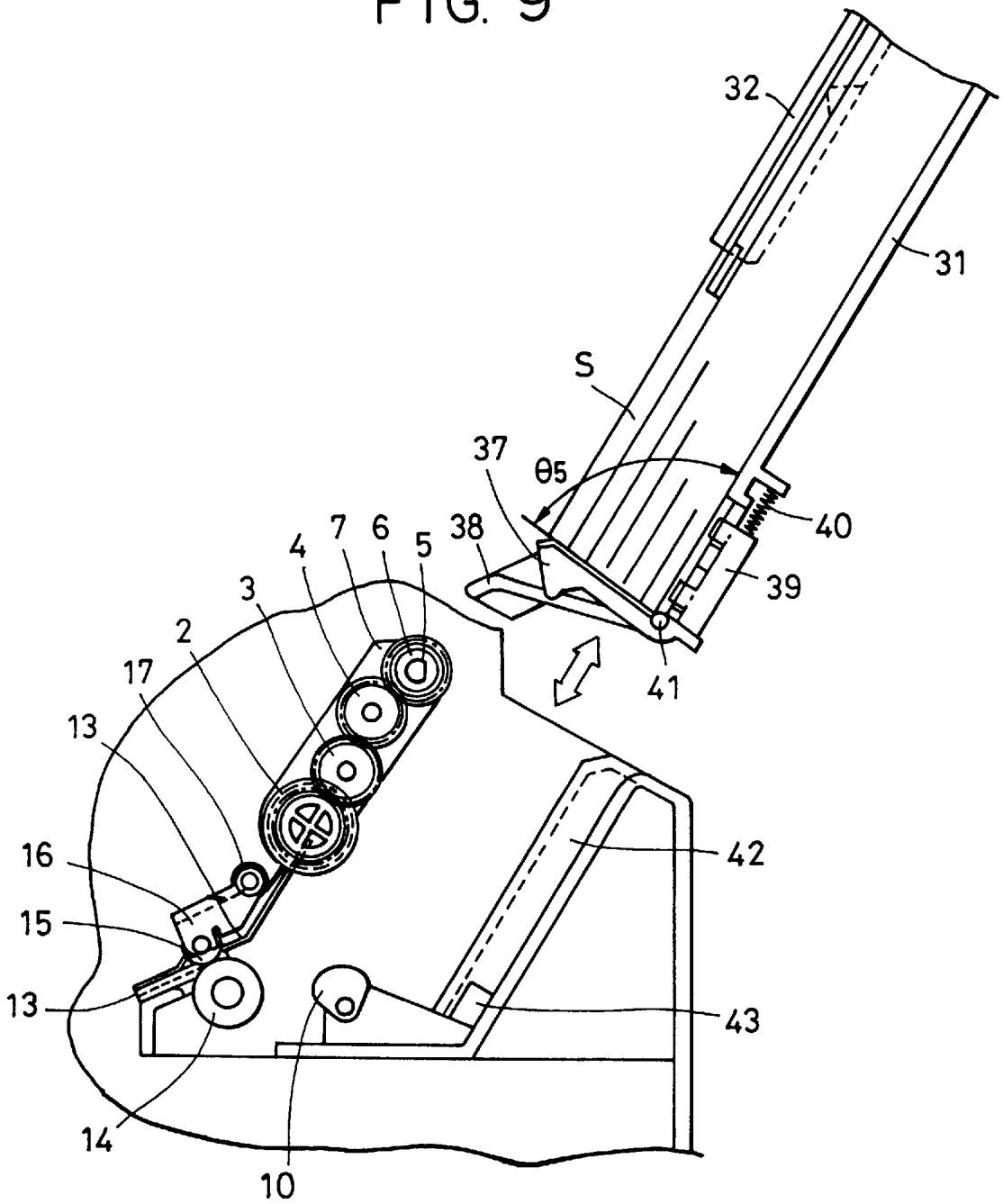
FIG. 9 is a schematic main sectional view showing the paper feeder and the paper feeding tray in a state in which the latter has not been attached to the former yet.
Figure 10:
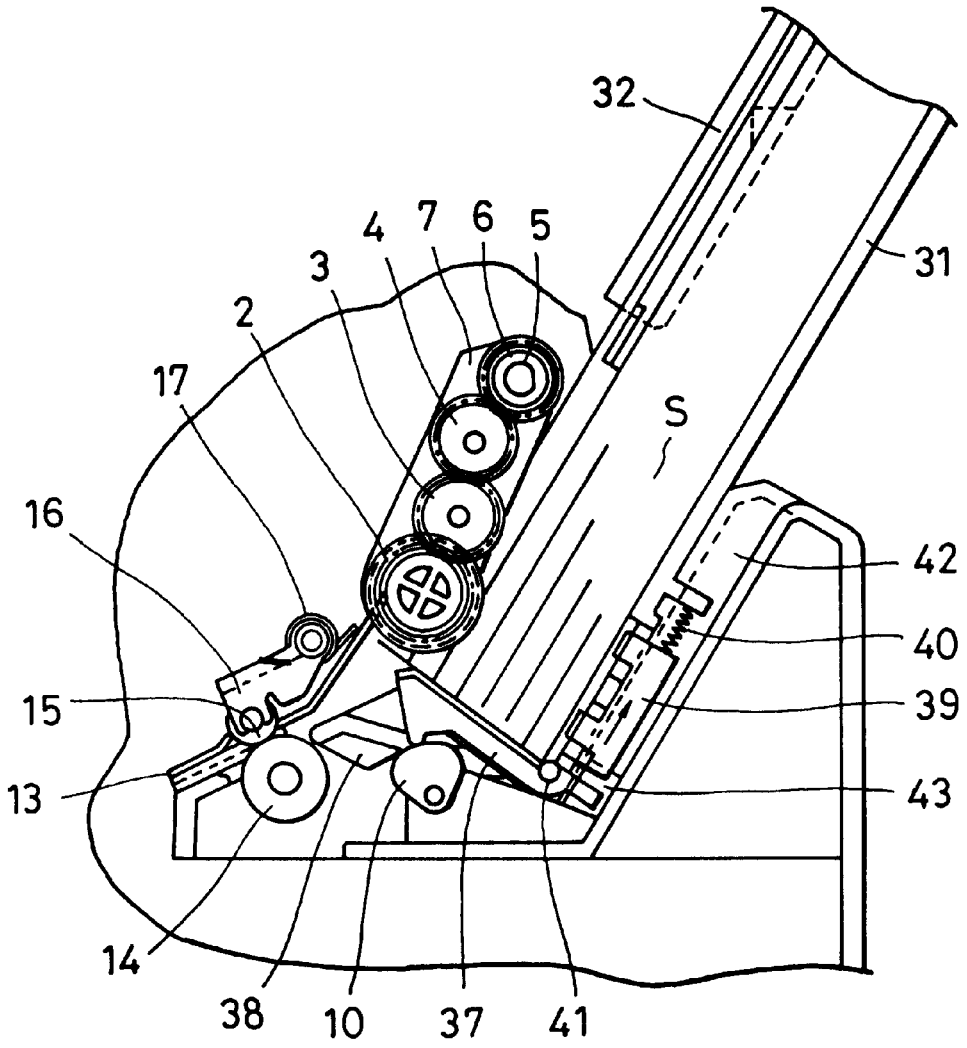
FIG. 10 is a main sectional view showing the paper feeding tray of the fourth embodiment attached to the paper feeder.

FIGS. 8, 9 and 10 show a fourth embodiment of the present invention. In the drawings, the components which are the same as those of the first embodiment are indicated by the same reference numerals.

In the drawings, numeral 31 indicates a paper feeding tray (paper feeding cassette) which can be attached and detached to and from an image forming apparatus or the like and which holds a pile of sheets on which printing is to be performed. In this embodiment, as shown in FIG. 9, the paper feeding tray 31 is attached such that the sheet stacking surface is inclined at least 10 degrees with respect to the horizontal plane.

With reference to FIG. 8, numeral 32 indicates a cover protecting the sheets stacked on the paper feeding tray 31 from dust, etc., numeral 33 indicates a right end reference plate for determining the position of the right end of the pile of sheets stacked, numeral 34 indicates a left end reference plate for determining the left end of the pile of sheets stacked, numeral 35 is a rear end reference plate for determining the rear end on the upstream side of the pile of sheets stacked, and numeral 36 indicates a separation sheet which has high coefficient of friction and which prevents multifold feeding of the lowermost sheet.

Numeral 37 indicates a movable separation slope surface, numeral 38 indicates a tray lower side guide for guiding the lower side of a sheet fed, and numeral 39 indicates a slope surface stopper for maintaining the movable separation slope surface 37 in the position shown in FIG. 9 when the paper feeding tray 31 is detached from the image forming apparatus.

Numeral 40 indicates a stopper spring for biasing the slope surface stopper 39, numeral 41 indicates a rotation shaft of the movable separation slope surface 37, numeral 42 indicates a paper feeding tray guide which is held by the image forming apparatus or the paper feeder and which receives the paper feeding tray 31, and numeral 43 indicates an abutting block which, when the paper feeding tray 31 is attached to the image forming apparatus, abuts the slope surface stopper 39 and pushes it in to make it possible for the position of the movable separation slope surface 37 to be switched by the separation control cam 10.

In the paper feeder constructed as described above, the supply of the pile of sheets and the paper feeding operation are conducted as follows. First, the paper feeding tray 31 is drawn out from the image forming apparatus to bring it to the condition shown in FIG. 8. The cover 32 is opened, and the left end reference plate 34, the right end reference plate 33, and the rear end reference plate 35 are set at positions matched with the size of the pile of sheets, and the pile of sheets S is put in. At this time, the movable separation slope surface 37 is maintained at angle θ5 shown in FIG. 9 by the slope surface stopper 39 biased by the stopper spring 40.

Next, the paper feeding tray 31 is attached in conformity with the paper feeding tray guide 42 held by the image forming apparatus. At this time, the slope surface stopper 39 abuts the abutting block 43 and moves to the position shown in FIG. 10, whereby the movable separation slope surface 37 is unlocked, and it is possible to vary its position in accordance with the phase of the separation control cam 10.

The paper feeding operation in the construction as described above is substantially the same as that of the first embodiment. While in this embodiment the paper feeding tray 31 holds the movable separation tray 37, the same effect can be obtained when the image forming apparatus holds the movable separation slope surface 37, and the paper feeding tray 31 has a fall stopper having the same construction as the slope surface stopper 39 of this embodiment and capable of fixation and canceling of fixation. While in the above-described embodiment the slope stopper 39 and the fall stopper are held by spring force, the same effect can be obtained by providing a mechanism for locking the stopper, the locking of which is canceled by the abutting portion or the like.

The above construction provides the following advantages.

(1) It is possible to realize a paper feeder which involves no inconvenience such as multifold feeding even when the paper feeding tray 31, which is installed vertically, is attached at an angle.

(2) Further, the paper feeder holds the movable separation slope surface 37 and the paper feeding tray 31 is provided with a fall stopper, whereby it is possible to operate the movable slope surface more accurately, thereby achieving an improvement in reliability.

Fifth Embodiment

Figure 11:
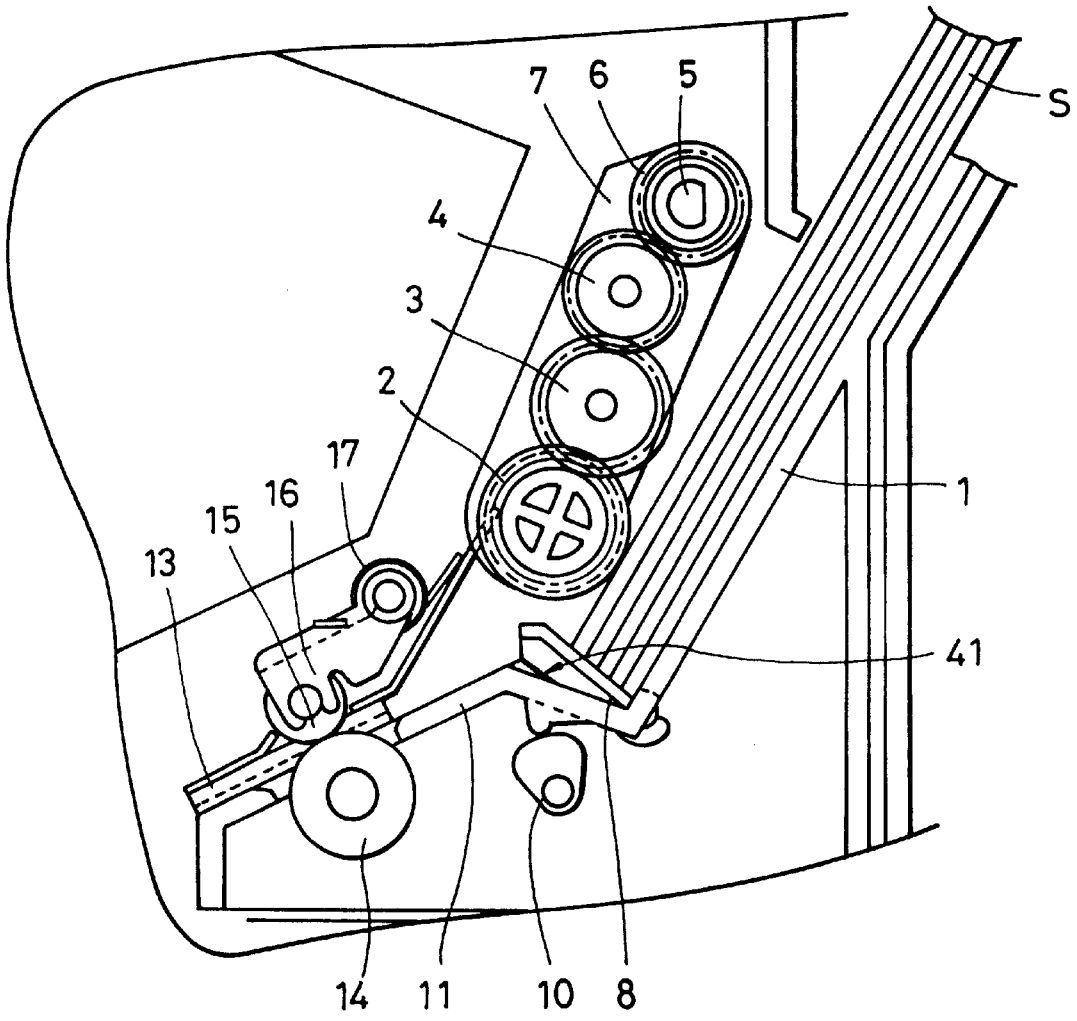
FIG. 11 is a main sectional view showing a paper feeder according to a fifth embodiment of the present invention in a standby state.
Figure 12:
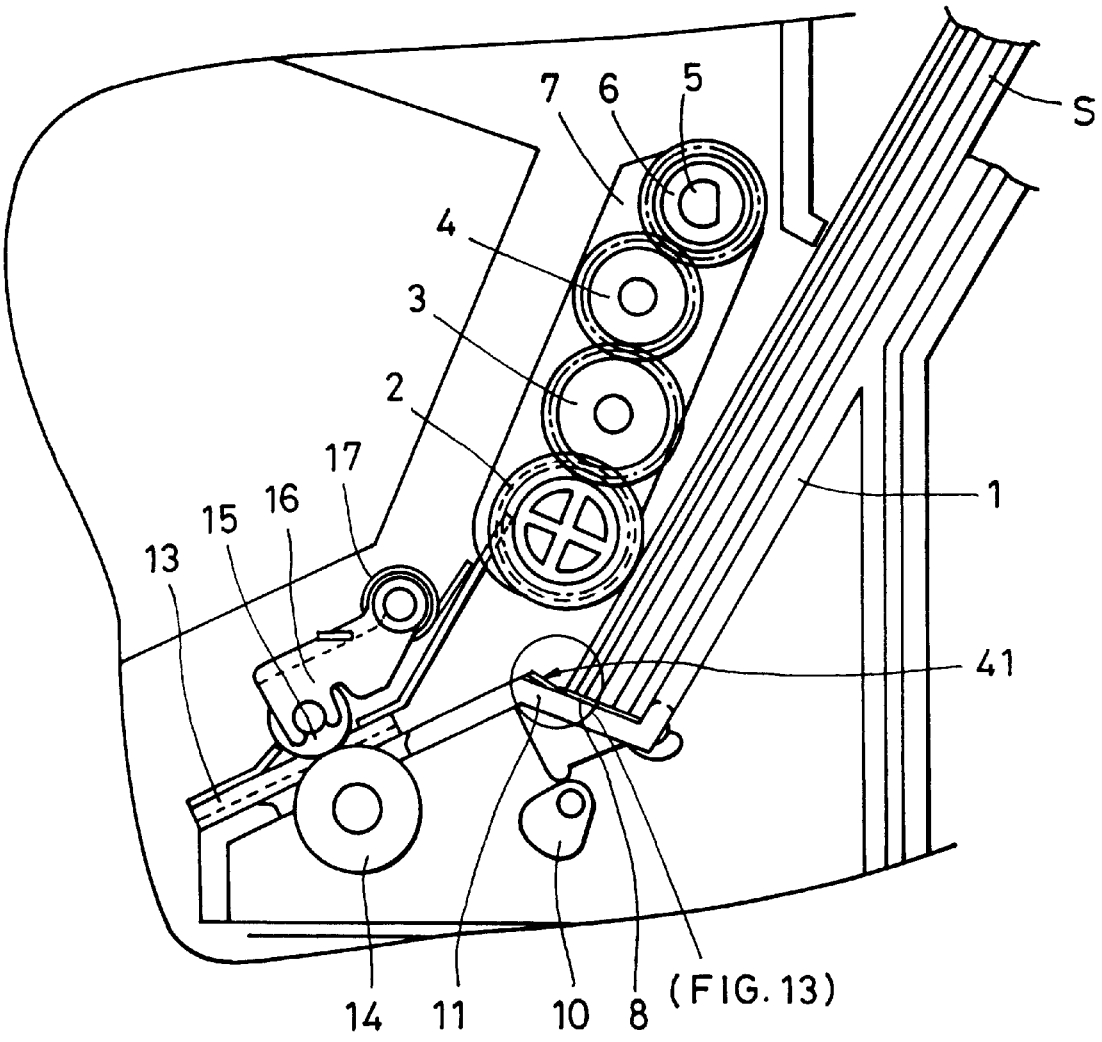
FIG. 12 is a main sectional view showing the paper feeder of the fifth embodiment during paper feeding operation.
Figure 13:
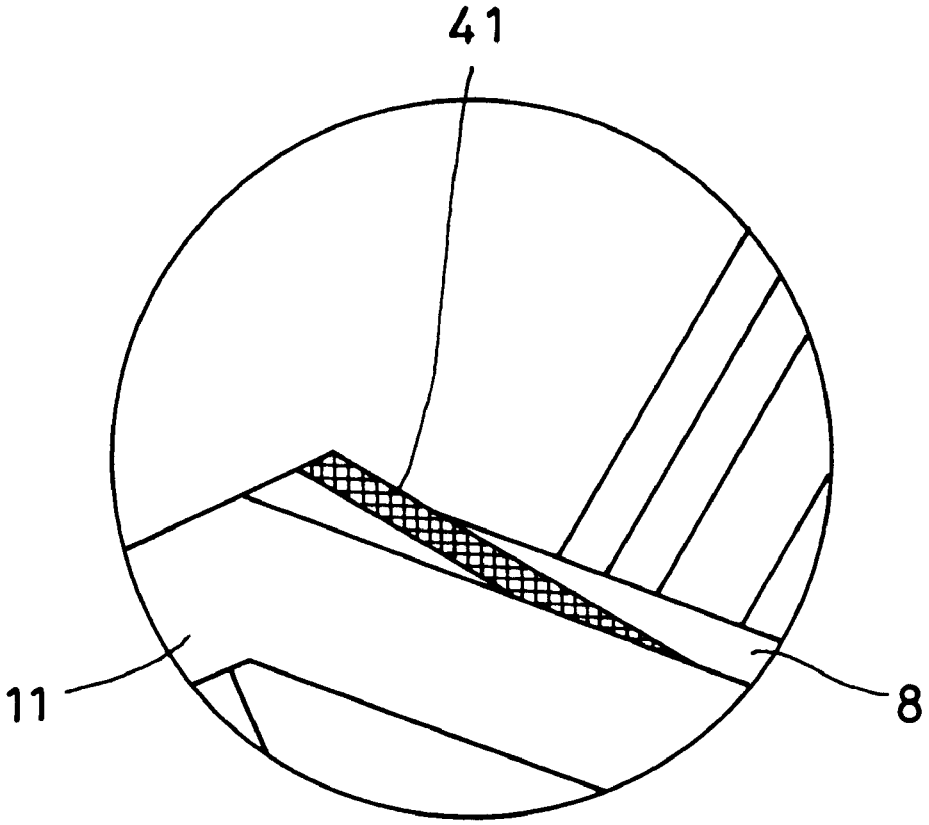
FIG. 13 is an enlarged view showing the arrangement of a multifold feeding preventing member according to the fifth embodiment.

FIGS. 11, 12 and 13 show a fifth embodiment of the present invention. In the drawings, the components which are the same as those of the first embodiment are indicated by the same reference numerals. In the drawings, numeral 41 indicates a multifold feeding preventing member having a high slide resistance, and which is fastened to the forward end guide surface 11. The high slide resistance is realized by the coefficient of friction of the material, the surface irregularities of the member, etc. FIG. 13 is an enlarged view showing that the multifold feeding preventing member 41 shown in FIG. 12 protrudes from the movable separation slope surface 8.

The paper feeding operation of the paper feeder constructed as described above is substantially the same as that of the first embodiment. In this embodiment, however, multifold feeding is prevented not only by separation by possibility/impossibility of sheet deformation along the movable separation slope surface 8 but also by the effect of stopping the sheets other than the uppermost sheet which receive weaker conveying force due to the friction between the sheets by the resistance when the forward end of the sheet passes the multifold feeding preventing member 41

The advantage peculiar to this embodiment will be described. When the multifold feeding preventing member is provided on the stationary separation slope surface 11, the pile of sheets S which has been brought to the state as shown in FIG. 15 will maintain its position by the resistance of the multifold feeding preventing member 41. Further, when the multifold feeding preventing member 41 provided directly on the movable separation slope surface 8, the forward end portion of the sheet which has buckled as in the above case may be maintained in the buckled state even when the movable separation slope surface 8 is restored to the standby state due to the resistance of the multifold feeding preventing member.

In this embodiment, when performing paper feeding, the resistance due to the multifold feeding preventing member 41 is applied to the forward end of the sheet to prevent multifold feeding, and, when paper feeding is completed, the multifold feeding preventing member 41 is at a position recessed from the movable separation slope surface 8, so that, as in the first embodiment, the buckling of the sheet can be easily canceled.

Figure 14:
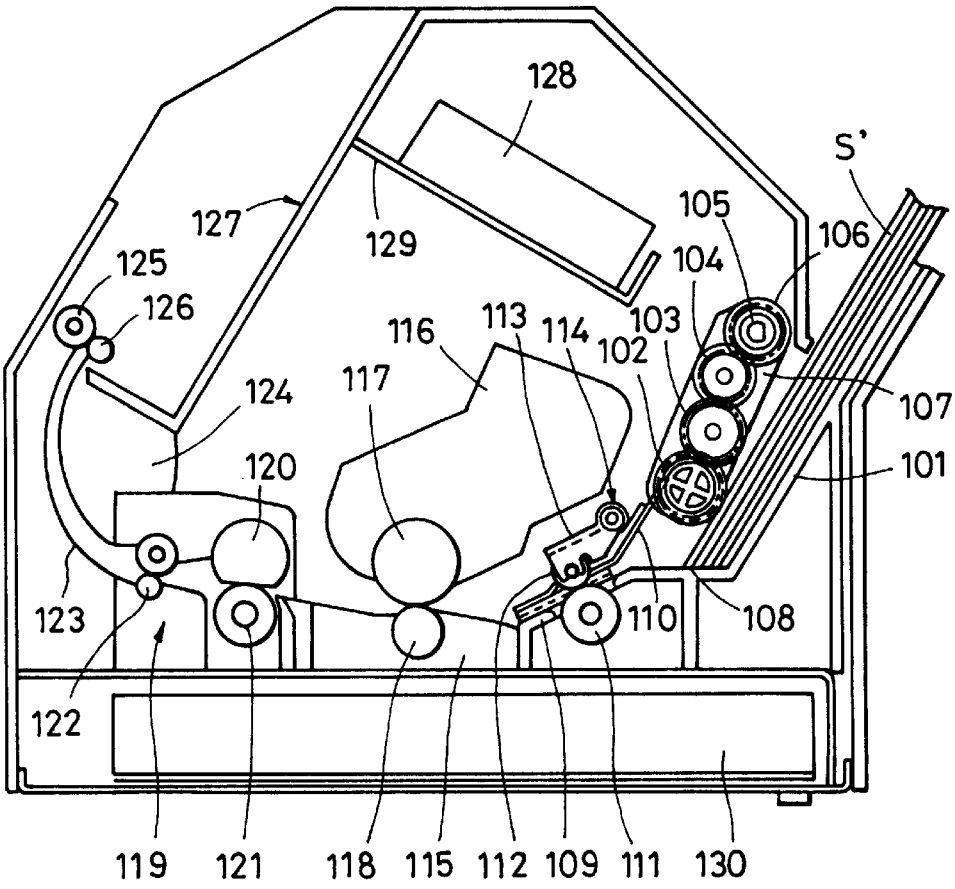
FIG. 14 is a main sectional view showing a conventional image forming apparatus.

While embodiments of the present invention have been described in detail, the present invention is not restricted to these embodiments. Further, the paper feeder of the above-described embodiments is applied not only to an electrophotographic image forming apparatus as shown in FIG. 14 but also to other type of image forming apparatus, such as an ink jet type image forming apparatus.

Further, while in the above embodiments the driving of the paper feeding roller 2 is started when the movable separation slope surface 8 has rotated to attain an angle θ2, this should not be construed restrictively. It is also possible to drive the paper feeding roller 2 when the angle made by the movable separation slope surface 8 and the sheet stacking surface 1 has become an obtuse angle to convey the sheet S1.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A paper feeder comprising:

a sheet stacking surface on which sheets are stacked;

paper feeding means for feeding the sheets stacked on said sheet stacking surface, said paper feeding means in contact with an uppermost sheet of the sheets stacked on said sheet stacking surface;

a movable separation slope surface, arranged such that a leading end of the sheets stacked on the sheet stacking surface abuts said movable separation slope surface, for separating the sheet fed by said paper feeding means one by one, said movable separation slope surface being rotatable between a first position and a second position that differ in inclination, angle made by said movable separation slope surface and said sheet stacking surface; and driving means for automatically rotating the movable separation slope surface between the first position and the second position in accordance with a paper feeding operation.

2. A paper feeder according to claim 1, wherein said driving means controls the movable separation slope surface such that the slope surface is in the first position for a fixed period of time in which a paper feeding operation is conducted by the paper feeding means and that the slope surface is in the second position for a period of time other than the fixed period of time in which the paper feeding operation is conducted, and wherein the angle made by the sheet stacking surface and the movable separation slope surface in the second position is smaller than the angle made by the sheet stacking surface and the movable separation slope surface in the first position.

3. A paper feeder according to claim 2, wherein the angle made by the sheet stacking surface and the movable separation slope surface in the first position is an obtuse angle and the angle made by the sheet stacking surface and the movable separation slope surface in the second position is an acute angle.

4. A paper feeder according to claim 1, wherein the driving means includes a cam which is contactable with a protrusion to the movable separation slope surface, said cam rotating to thereby rotate the movable separation slope surface.

5. A paper feeder according to claim 1, further comprising a rotatably supported roller arranged at the end of the movable separation slope surface which is on the side spaced apart from the sheet stacking surface.

6. A paper feeder according to claim 1, wherein said paper feeding means has a first and a second paper feeding operation, and wherein, in the first paper feeding operation, the movable separation slope surface is not moved to the second position, and wherein, in the second paper feeding operation, the movable separation slope surface is moved from the first position to the second position.

7. A paper feeder according to claim 1, wherein said paper feeding means delays starting relative to starting of rotation of the movable separation slope surface.

8. A paper feeder according to claim 1, further comprising a multifold feeding preventing member positioned to protrude from and retract into the movable separation slope surface, wherein, when the movable separation slope surface is in the second position, the multifold feeding preventing member is positioned so as not to protrude from the movable separation slope surface, and wherein, when the movable separation slope surface is in the first position, the multifold feeding preventing member is positioned so as to protrude from the movable separation slope surface.

9. A paper feeder according to claim 1, further comprising a slope surface stopper for restricting the rotation of the movable separation slope surface, wherein the sheet stacking surface, the movable separation slope surface, and the slope stopper are provided in a paper feeding tray which is attachable to and detachable from the paper feeder main body.

10. A paper feeder according to claim 1, wherein the sheet stacking surface is provided in a paper feeding tray which is attachable to and detachable from the paper feeder main body and wherein the movable separation slope surface is provided in the paper feeder main body.

11. A paper feeder according to claim 1, wherein the sheet stacking surface is inclined at least 10 degrees with respect to a horizontal plane, and wherein said paper feeding means feeds sheets downwardly with respect to the horizontal plane.

12. An image forming apparatus comprising:

a sheet stacking surface on which sheets are stacked;

paper feeding means for feeding the sheets stacked on said sheet stacking surface, said paper feeding means in contact with an uppermost sheet of the sheets stacked on said sheet stacking surface;

a movable separation slope surface, arranged such that a leading end of the sheets stacked on the sheet stacking surface abuts said movable separation slope surface, for separating the sheet fed by said paper feeding means one by one, said movable separation slope surface, being rotatable between a first position and a second position that differ in inclination angle made by said movable separation slope surface and said sheet stacking surface;

driving means for automatically rotating the movable separation slope surface between the first position and the second position in accordance with a paper feeding operation; and image forming means for forming an image on the fed sheets.

13. An image forming apparatus according to claim 12, wherein said driving means controls the movable separation slope surface such that the slope surface is in the first position for a fixed period of time in which a paper feeding operation is conducted by the paper feeding means and that the slope surface is in the second position for a period of time other than the fixed period of time in which the paper feeding operation is conducted, and wherein the angle made by the sheet stacking surface and the movable separation slope surface in the second position is smaller than the angle made by the sheet stacking surface and the movable separation slope surface-in the first position.

14. An image forming apparatus according to claim 13, wherein the angle made by the sheet stacking surface and the movable separation slope surface in the first position is an obtuse angle and the angle made by the sheet stacking surface and the movable separation slope surface in the second position is an acute angle.

15. An image forming apparatus according to claim 12, wherein the driving means includes a cam which is contactable with a protrusion to the movable separation slope surface, said cam rotating to thereby rotate the movable separation slope surface.

16. An image forming apparatus according to claim 12, further comprising a rotatably supported roller arranged at the end of the movable separation slope surface which is on the side spaced apart from the sheet stacking surface.

17. A paper feeder according to claim 12, wherein said paper feeding means has a first and a second paper feeding operation, and wherein, in the first paper feeding operation, the movable separation slope surface is not moved to the second position, and wherein, in the second paper feeding operation, the movable separation slope surface is moved from the first position to the second position.

18. An image forming apparatus according to claim 12, wherein said paper feeding means delays starting relative to starting of rotation of the movable separation slope surface.

19. An image forming apparatus according to claim 12, further comprising a multifold feeding preventing member positioned to protrude from and retract into the movable separation slope surface, wherein, when the movable separation slope surface is in the second position, the multifold feeding preventing member is positioned so as not to protrude from the movable separation slope surface, and wherein, when the movable separation slope surface is in the first position, the multifold feeding preventing member is positioned so as to protrude from the movable separation slope surface.

20. An image forming apparatus according to claim 12, further comprising a slope surface stopper for restricting the rotation of the movable separation slope surface, wherein the sheet stacking surface, the movable separation slope surface, and the slope stopper are provided in a paper feeding tray which is attachable to and detachable from the paper feeder main body.

21. An image forming apparatus according to claim 12, wherein the sheet stacking surface is provided in a paper feeding tray which is attachable to and detachable from the paper feeder main body and wherein the movable separation slope surface is provided in the paper feeder main body.

22. An image forming apparatus according to claim 12, wherein the sheet stacking surface is inclined at least 10 degrees with respect to a horizontal plane, and wherein said paper feeding means feeds sheets downwardly with respect to the horizontal plane.

* * * * *

UNITED STATES PATENT AND TRADEMARK OFFICE

CERTIFICATE OF CORRECTION

PATENT NO. : 6,382,621 B1
DATED : May 7, 2002
INVENTOR(S) : Ryukichi Inoue et al.

It is certified that error appears in the above-identified patent and that said Letters Patent is hereby corrected as shown below:

Column 3,
Line 15, “sheet” should read -- sheets --.
Line 36, “slope-surface,” should read -- slope surface, --.

Column 8,
Line 11, “Si” should read -- S1 --.

Column 11,
Line 51, “inclination,” should read -- inclination --.

Signed and Sealed this

Ninth Day of July, 2002

*Attest:*

*Attesting Officer*

JAMES E. ROGAN
*Director of the United States Patent and Trademark Office*